US005188266A

United States Patent [19]

Loulias

[11] Patent Number: 5,188,266

[45] Date of Patent: Feb. 23, 1993

[54] PORTABLE BEVERAGE CONTAINER

[76] Inventor: Kris P. Loulias, 581 Park St., Midvale, Utah 84047

[21] Appl. No.: 664,629

[22] Filed: Mar. 4, 1991

Related U.S. Application Data

[63] Continuation-in-part of Ser. No. 378,171, Jul. 11, 1989, abandoned, which is a continuation-in-part of Ser. No. 944,823, Dec. 19, 1986, abandoned.

[51] Int. Cl.[5] ..... A45F 5/00

[52] U.S. Cl. ..... 224/148; 224/151; 224/205; 383/110; 383/111

[58] Field of Search ..... 224/148, 205, 202, 151; 215/204; 383/71, 111, 110, 97, 80, 906, 904, 901

[56] References Cited

U.S. PATENT DOCUMENTS

| | | | |
|---|---|---|---|
| D. 234,939 | 4/1975 | Hagert et al. | D3/30.1 |
| D. 237,047 | 10/1975 | Westrich | D3/30.1 |
| D. 237,862 | 12/1975 | Westrich | D3/30.1 |
| D. 238,248 | 12/1975 | Westrich | D3/30.1 |
| 1,358,133 | 11/1970 | Applegate | 383/110 |
| 2,494,632 | 1/1970 | Rodiin | 224/148 |
| 3,814,288 | 6/1974 | Westrich | 224/148 |
| 3,830,270 | 8/1974 | Hagert et al. | 224/205 |
| 3,906,129 | 9/1975 | Damois | 383/110 |
| 4,139,130 | 2/1979 | Glusker et al. | 224/148 |
| 4,248,366 | 2/1981 | Christiansen | 224/148 |
| 4,515,300 | 5/1985 | Cohen | 224/151 |

*Primary Examiner*—Linda J. Sholl

*Attorney, Agent, or Firm*—Mallinckrodt & Mallinckrodt

[57] ABSTRACT

A portable container for liquids is provided, comprising an insulated outer casing having a narrow neck portion opening into a larger portion, and sized and configured to enclose a removable, and preferably disposable, inner vessel also having a narrow neck portion opening into a larger liquid storage portion. A releasable clamp is secured to the neck portion of the outer casing and adapted to cooperate with a substantially rigid neck for the inner vessel to securely hold the neck of the inner vessel in a fixed position with respect to the outer casing. The substantially rigid neck for the inner vessel may be formed as part of the vessel itself or may be formed as an insert for the neck portion of the inner vessel. When formed as an insert for the neck portion of the inner vessel, the clamp will seal the neck portion of the inner vessel to the substantially rigid neck to prevent leakage of the contents of the inner vessel around the neck, as well as hold the neck in position in the outer casing. A cap attachment for the substantially rigid neck is provided for securing the contents of the inner vessel within the inner vessel.

20 Claims, 4 Drawing Sheets

PORTABLE BEVERAGE CONTAINER

RELATED APPLICATION

This is a continuation-in-part of my copending application Ser. No. 07/378,171 filed Jul. 11, 1989 now abandoned, entitled Portable Beverage Container, which was a continuation-in-part of application for design patent Ser. No. 944,823, filed Dec. 19, 1986, entitled Beverage Container, now abandoned.

BACKGROUND OF THE INVENTION

1. Field

The invention is in the field of portable beverage or water containers, particularly flasks or bota bags.

2. State of the Art

Portable beverage or water containers are usually shaped and sized so as to be easily carried by a person traveling on foot, such as a backpacker. Throughout the years the shapes that have become most popular are those of relatively flat flasks or bota bags, having a narrow neck portion for dispensing of the liquid contained therein. Many such containers have an inner vessel and a separate outer covering or casing, often including insulation for maintaining the desired temperature of the liquid contained within the inner vessel, be it hot or cold. The narrow neck portion serves to facilitate drinking from the container. A removeable closure cap is, of course, also provided to prevent spilling of the contents. In some cases, the closure cap has means for selecting the size of the opening, one size being suitable for pouring and a smaller size suitable for squirting.

A common problem with state-of-the-art containers is the difficulty of cleaning the inside of the container since access is obtained only through the narrow neck portion. Plastic containers and inner vessels often become contaminated, leaving an undesirable after-taste of the previous beverage used. Typical of such containers is the leather encased flask described in U.S. Pat. No. 3,830,270, by Hagert et al, and the generic bota bag having a permanent plastic inner vessel.

SUMMARY OF THE INVENTION

The invention comprises a removable inner vessel for containing a liquid, an outer insulated casing sized and configured to enclose the inner vessel, and a cap assembly adapted to close the opening into the inner vessel. The outer casing and the inner vessel are both preferably kidney shaped, similar to a bota bag, with a narrow neck opening at the apex of the kidney. The outer casing has an elongate opening along its elongate end adapted for insertion of the inner vessel, and equipped with a zipper and Velcro means for closing the opening after insertion of the inner vessel. The outer casing also has a clamp, preferably of the hose clamp variety, internally attached to the narrow neck portion of the outer casing, into which the narrow neck portion of the inner vessel can be positioned. Thus, when the clamp is tightened, the neck of the inner vessel is securely attached in a fixed position with respect to the outer casing. In some embodiments of the inner vessel, this clamping provides a seal around the neck of the inner vessel to prevent leakage of the contents of the inner vessel about the neck, and in all embodiments, the clamp serves to prevent the neck of the inner vessel from slipping down into the outer casing.

Versions of the inner vessel which are substantially rigid, or semi-rigid, may be secured to the outer casing by means of the clamp grasping or clamping an appropriately configured portion of the neck of the inner vessel. Other versions of the inner vessel require the insertion of a separate rigid neck stiffening member into the neck portion of the inner vessel, thus providing means for clamping. With such embodiments, the narrow neck portion of the inner vessel is sealed around the inserted neck stiffening member as by the clamp. As an option, a cylindrical band of resilient material, such as rubber, may be emplaced between the clamp and the neck of the inner vessel, thus aiding in the sealing and prevention of leakage.

The outer casing is preferably fashioned from a decorative fabric having an insulated liner, and equipped with a rigid, or semi-rigid, flat bottom thus adapting it to be set upright on a table. It is also equipped with a strap, adapted to be carried over the shoulder or around the waist.

The inner vessel may be adapted to be reusable, after cleaning, but is preferably of a disposable type. Thus, the inner vessel may be formed from a thin plastic sheet, or may consist of a foil lined bag, or may be a rigid or semi-rigid plastic or glass bottle.

Versions of the inner vessel which consist of thin plastic bags, or foil lined bags, may be folded flat and packaged with several inner vessels in a package.

Inner vessels may also be prefilled with a beverage, and capped with a disposable cap, thus being adapted for marketing from a retail outlet.

The invention also includes a removable cap assembly, tethered to the outer case by a cord or strap so as to prevent loss. The cap assembly preferably includes means whereby the liquid in the inner vessel may be poured from the inner vessel, or may be throttled down to a narrow stream and thus effectively squirted from the inner vessel. The means for accomplishing this includes a throttle member, attached to the neck opening of the inner vessel, and having a restricted exit opening which is smaller than the opening in the neck of the inner vessel, and a removable closure member or cap which closes the exit opening of the throttle member.

THE DRAWINGS

The best mode presently contemplated for carrying out the invention is illustrated in the accompanying drawings in which:

FIG. 1 is a perspective view of a bota bag having an outer casing, an inner vessel (not visible) enclosed therein, a cap assembly with a tethering cord (shown partially) attached thereto, and a carrying strap (shown partially);

FIG. 2, a top plan view of the apex of the bota bag with the inner vessel removed, the hose clamp opened, the securing strap opened, and the Velcro closure strips opened;

FIG. 3, a side elevational view of the bota bag with an inner vessel enclosed therein, the zipper being partially open and the hose clamp released;

FIG. 4, a schematic elevational view of an inner vessel formed from two thin plastic half-sections;

FIG. 5, a fragmentary perspective view of one optional neck attachment means comprising a separate neck stiffening member shown inserted into the narrow neck of an inner vessel;

FIG. 6, a similar view but in elevation showing a second optional neck attachment means comprising a separate neck stiffening member which also has cap assembly attachment means;

FIG. 7, a view largely similar to that of FIG. 6 showing the narrow neck portion of an inner vessel having an integral built-in neck attachment means and cap assembly attachement means;

FIG. 8, an exploded view of a neck attachment means comprising a separate neck-stiffening member, and a cap assembly comprising a throttle member and a closure cap member;

FIG. 9, a view in elevation shownig an optional cap assembly hingedly attached to a cap attachment member;

FIG. 10, a perspective assembly view of a further embodiment of a separate neck stiffening member of the invention; and FIG. 11, a fragmentary perspective view similar to FIG. 10, showing the neck stiffening member in place in the inner vessel and the inner vessel clamped to the outer casing.

DETAILED DESCRIPTION OF THE ILLUSTRATED EMBODIMENTS

Figure 1:
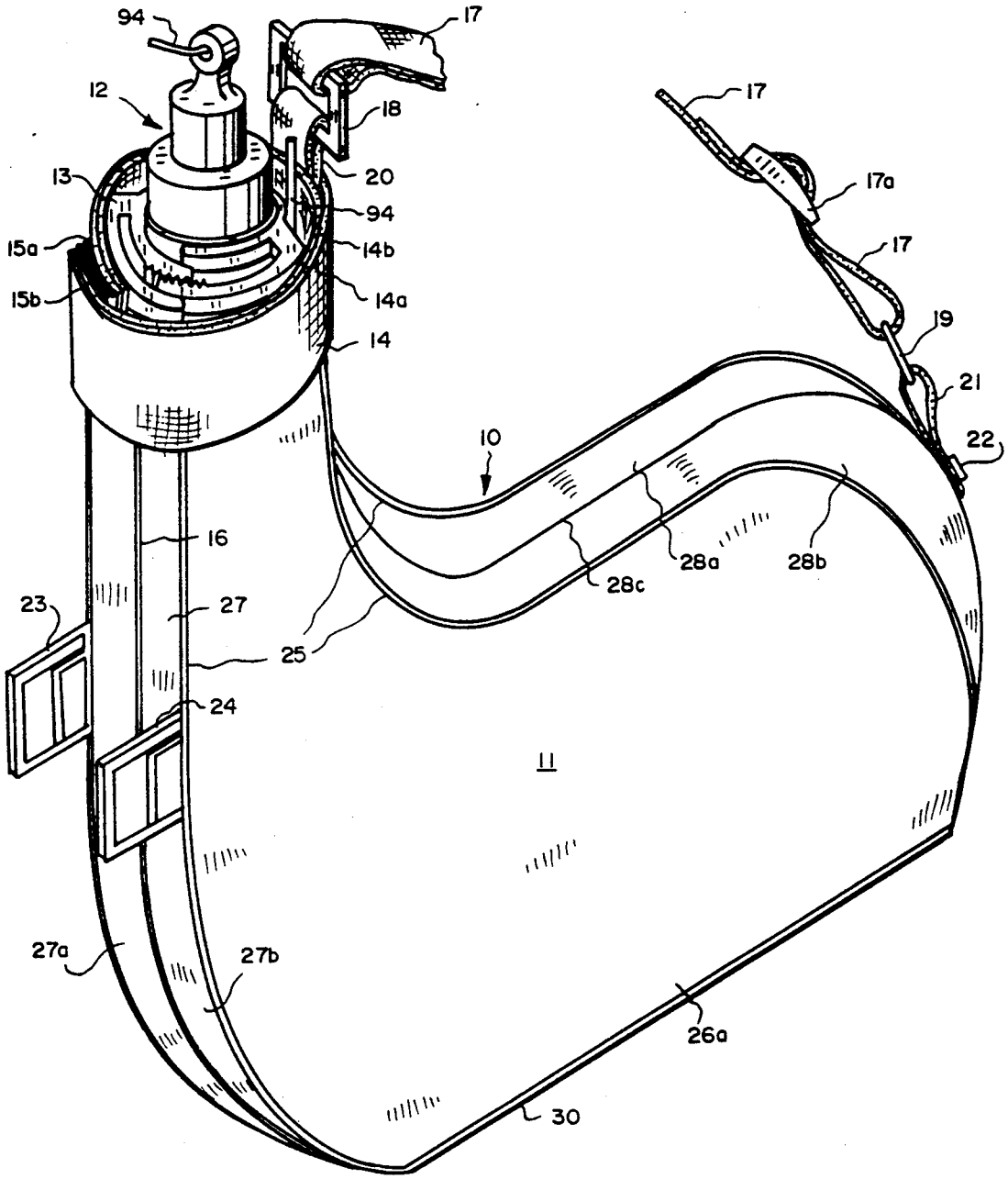

The invention, in the form of a kidney-shaped bota bag, is shown in perspective in FIG. 1. In this view, the bota bag 10 has an inner vessel (not visible) contained within the outer casing 11. A cap assembly 12 is also shown, assembled in place to close the inner vessel. A hose clamp 13 cooperates with neck attachment means so as to clamp around the narrow neck of the inner vessel. A securing strap 14 encircles the apex of the narrow neck of the outer casing 11, with a Velcro closure strip, comprising parts 15*a* and 15*b*, attached thereto. The outer casing 11 is closed by means of a zipper (not visible in this view) positioned behind slit 16 located in the elongate end panel 27, as shown.

A carrying strap 17 (shown partially, FIG. 1) is attached to loops 18 and 19 of respective fittings, which, in turn, are attached to outer casing 11 by means of folded-over webbing strips 20 and 21, all positioned as shown. Webbing strip 21 is attached to end panel 28 by swivel rivet 22. Carrying strap 17 is adjustable in length, as by buckle 17*a*, and has a quick disconnect portion, such as a Fastex buckle, not shown, inserted intermediate its length, the strap and buckle being of a typical construction well known in the industry and not further described herein. With the carrying strap 17 attached as shown in FIG. 1, the bota bag is adapted for carrying over the shoulder. In addition, another pair of loop fittings 23 and 24 are provided, positioned as shown, to either of which the carrying strap 17 may be attached, instead of to loop 18, thus adapting the bota bag for carrying around the waist in a typical fashion not further described herein. Swivel rivet 22 facilitates this optional method of carrying.

The outer casing 11 is preferably fashioned from panels of a water resistant, washable, decorative fabric, such as Pack cloth or Cordura, with decorative piping 25 serving as means for stitching the various panels together, as well as providing a decorative design, all as customarily done in the fabric industry and not described further herein. Outer casing 11 has two similar side panels, 26*a* and 26*b*, see FIGS. 1 and 3, an elongate end panel 27 and a bowed end panel 28, all as shown. Elongate end panel 27 is slit (16) along substantially its entire length, forming two partial panels 27*a* and 27*b*, with an opening 29 between their corresponding edges, which opening is adapted to be closed with the zipper 32 as noted above. Bowed end panel 28 may, as an option, be formed from a pair of similar partial panels 28*a* and 28*b* with their corresponding apposite edges stitched together as at seam 28*c*. This arrangement may serve to simplify the manufacturing process.

The bottom 30 of the outer casing is formed as a flat surface and may be fashioned from an elongate relatively stiff strip of plastic or fiber, having a strip of webbing affixed to its outer surface, and stitched along its edges to the side panels and end panels of the outer casing. This feature allows the bota bag to be set upright on a table, a feature not found in other bota bags.

Figure 3:
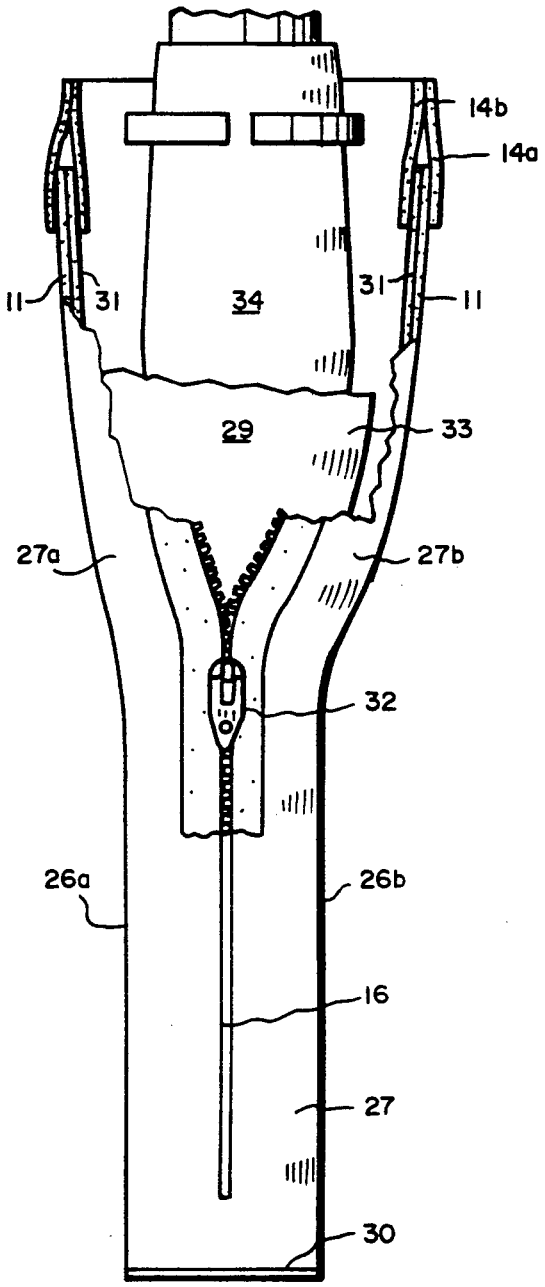

In addition, the outer casing has a washable, insulating lining 31, FIG. 3, secured to its inner surface, covering substantially the entire inner surface, thus serving to maintain the temperature of a liquid contained in the inner vessel, whether hot or cold.

Figure 2:
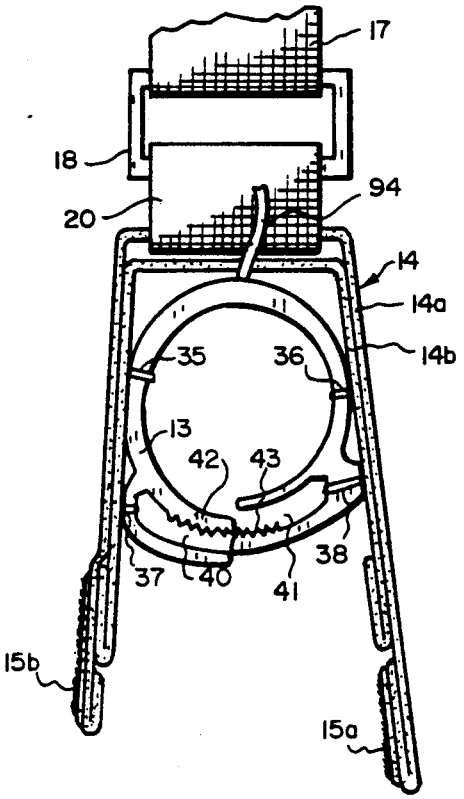

Access to the interior of the outer casing is afforded by means of elongate opening 29, see FIGS. 2 and 3, in elongate end panel 27. Opening 29 is closed by means of nylon zipper 32, assembled as shown. A flap 33, FIG. 3, is preferably stitched along one edge to the inner face of partial end panel 27*a* or 27*b*, being so sized and configured as to substantially cover opening 29, and to separate zipper 32 from the inner vessel 34, thus serving to protect the inner vessel from being caught by the zipper.

A plan view of the apex of the bota bag is shown in FIG. 2, with the inner vessel removed, the securing strap 14 opened, the Velcro closure strips 15*a* and 15*b* opened, and the hose clamp 13 opened. The securing strap 14 comprises two webbing straps 14*a* and 14*b* stitched together around the perimeter of their upper edges, and having the apex of the narrow neck of the outer casing 11 sandwiched between their lower portions, and stitched thereto, as shown in FIG. 3. The Velcro closure strip has one piece 15*a* stitched to the inner face of webbing strap 14*a* at one end and its opposite barbed piece 15*b* stitched to the outer face of the opposite end of webbing strap 14*a*, all as shown.

In addition, folded-over strip of webbing 20, encircling a leg of a loop 18 for carrying strap 17, has its ends sandwiched between webbing straps 14*a* and 14*b*, and stitched thereto, positioned as shown in FIGS. 1 and 2.

Hose clamp 13 is attached to the inner face of webbing strap 14*b* by stitching 35, 36, 37, and 38, all as shown, thus firmly securing it to the narrow neck of outer casing 11. Hose clamp 13 may consist of any one of several varieties of releasable hose clamps available, having a generally cylindrical opening with an internal diameter somewhat larger than a cylindrical object to be clamped therein, adapted to having a cylindrical object inserted therein, and having means for subsequent reduction, or partial collapsing, of the internal diameter of the clamp, thereby causing the clamp to grasp the inserted object and apply an inward force thereon and to thereby maintain the object securely clamped in position until a user intentionally opens the clamp. It is important to note that the clamp utilized should be a releasable type wherein the object to be clamped is emplaced within the encircling configuration of the clamp, and subsequently clamped, by a motion that does not rely to any significant extent on relative rotation of the object with respect to the clamp. Significant relative rotation would be very awkward, if not impossible, for an object shaped like a bota bag. In the preferred embodiment illustrated, hose clamp 13 is a molded plastic piece having a pair of opposing jaws 40 and 41, fashioned and sized so as to mesh snugly together when clamping is to be effected. Jaws 40 and 41 also have inclined ridges 42 and 43 which act as a ratchet, thus preventing the jaws from inadvertently opening when once engaged. When a user desires to open the clamp, he simply forces one of the jaws upwardly or downwardly with respect to the opposing jaw until it disengages from the opposing jaw. A standard hose clamp of this variety may be obtained from Heyco, Kenilworth, N.J., identified as Hose Mate.

Several different types of inner vessels may be employed in conjunction with the bota bag. Preferably, but not exclusively, the inner vessel will be of a disposable type. This option eliminates the necessity for cleaning the inside of the inner vessel after use, a procedure which is very difficult with the customary bota bag or flask since access to the interior is obtained only by way of the narrow neck. Oftentimes adequate cleaning is impossible, resulting in an after-taste of the previous beverage employed.

The inner vessel is configured so as to nestle snugly within the outer casing when filled with a liquid. Its shape is substantially the same as that of the outer casing, but of somewhat smaller dimensions.

Figure 4:
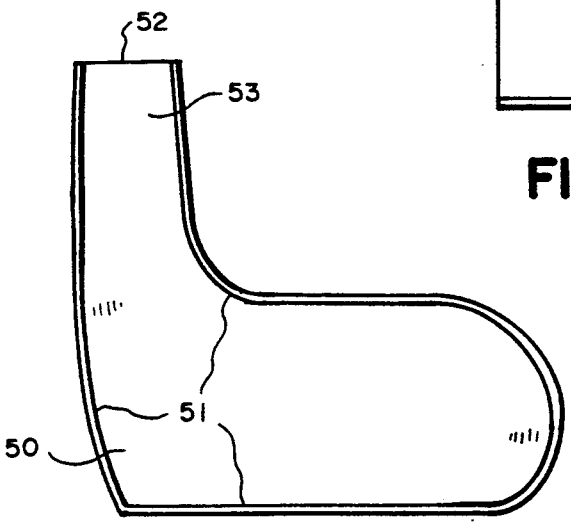

One embodiment of an inner vessel 50 is shown in FIG. 4. This embodiment is formed from two identical half segments fashioned from a thin plastic sheet wherein the two segments are sealed together along their outer perimeter edges 51 at all points except for the edges 52 at the apex of the narrow neck region, which thus provides an opening into the inner vessel. For certain applications, the plastic sheet can be lined with foil. Several inner vessels formed in this fashion could be stacked together for convenient packaging, or could be arranged in a roll and adapted to be separated from each other by tearing along perforations, similar to sandwich bags.

The inner vessel must have a substantially rigid neck attachment means associated with it which will cooperate with the clamp, described above, so as to secure the neck of the inner vessel to the neck of the outer casing.

Figure 5:
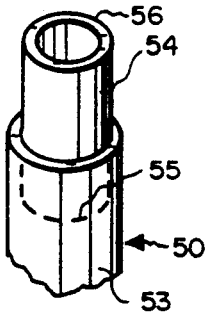

An embodiment of an inner vessel, which does not have a rigid or semi-rigid neck, such as 50, and requires a separate neck attachment or inner vessel neck means for stiffening the narrow neck portion 53 so as to enable it to be clamped by hose clamp 13 so as to be firmly secured to outer casing 11 in a fixed relative position, thus preventing the neck of the inner vessel from sliding down into the outer casing as the contents of the inner vessel are dispensed therefrom, is shown. One such neck attachment or inner vessel neck means comprises a cylindrical neck stiffening member 54, see FIG. 5, sized at one end 55 so as to fit snugly within the narrow neck portion 53 of inner vessel 50, with its other end 56 protruding therefrom. Inner vessel 50 is adapted for emplacement in outer casing 11 by inserting end 55 of neck stiffening member 54 into the narrow neck 53 of inner vessel 50. Inner vessel 50 is inserted into outer casing 11 through opening 29, with narrow neck portion 53 surrounding neck stiffening member 54 and being positioned into the encircling portion of clamp 13 such that the encircling portion can clamp around end 55 of the neck stiffening member with the wall of the narrow neck portion 53 of the inner vessel being held between the clamp and the neck stiffening member. Thus, the narrow neck portion of the inner vessel is held in a fixed relative position with respect to the narrow neck portion of the outer casing, and the clamping force of the clamp about the narrow neck portion 53 of the inner vessel holds narrow neck portion 53 securely around end 55 of the neck stiffening member 54 so as to seal it to member 54 to prevent leakage of the contents of the inner vessel around neck stiffening member 54. In this way, the neck attachment means is sealingly and removeably received in the neck portion of the inner vessel and forms an inner vessel neck means. As an option, the neck stiffening member could be permanently sealed in the narrow neck portion of the inner vessel.

Figure 6:
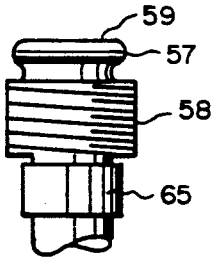

Various options exist for structure of the protruding end of the neck stiffening member, depending on the specific application desired. A preferred option when the neck is permanently sealed to the inner vessel, so it can be prefilled, is depicted in FIG. 6. End 59 has a ridge 57 formed around it, suitable for attachment of a standard disposable press-fitting bottle cap (not shown), as is commonly used with soft drink bottles. This provides a means whereby a soft drink bottler can prefill the inner vessel, attach a disposable press-fitting cap, and then market the prefilled inner vessel for use with a bota bag of the invention. The neck stiffening member is also configured with threads 58, as shown, adapted for attachment by a bottler of a disposable threaded cap (not shown) rather than a press-fitting cap, and for subsequent attachment by a user of a removable cap assembly to be described further on. The configuration is such that the root diameter of the threads 58 would be at least slightly greater than the external diameter of ridge 57, thus allowing a cylindrical threaded cap assembly to be slipped over the ridge and threadedly engaged with threads 58. This arrangement provides a unique advantage to the user, whereby the user may insert a prefilled inner vessel into the outer casing of his bota bag, remove the disposable press-fitting cap or disposable threaded cap, and attach a threaded removable cap assembly supplied with the casing of the invention. The user can then dispense portions of the contents from time to time as desired, resealing the inner vessel after each dispensing, without the use of tools.

Figure 7:
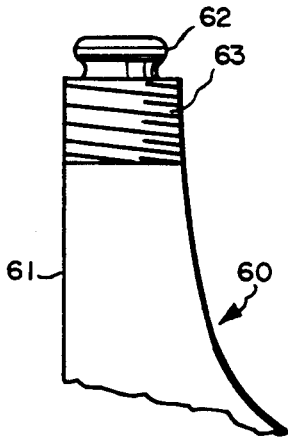

Another embodiment 60 of an inner vessel is shown in FIG. 7. In this embodiment the inner vessel 60 is formed of rigid or semi-rigid material, such as glass or relatively thick plastic, and is structured to provide its own neck attachment means, thus eliminating the requirement for a separate neck stiffening member. The narrow neck portion 61 has a ridge 62 and threads 63, similar to those described above. Thus, the application would be similar to that described above.

Alternatively, for both of the above embodiments, the ridge may be eliminated so only a threaded portion is supplied, or a cork or bottle stopper may be employed as a removable cap assembly, thus eliminating the need for the threads and/or the ridge.

As a still further option, a cylindrical band of resilient material, such as rubber, may be incorporated encircling the neck of the neck stiffening member, as shown as 65 in FIG. 6. This band of resilient material is positioned so it is between the neck of the inner vessel and the neck stiffening member so as to augment the sealing action of the clamp, thus further acting to prevent leakage. This could be of importance in preventing leakage that might otherwise be caused by undue pressure on the outer casing, and thus the inner vessel, such as caused by squeezing the bag or placing a heavy object on the bota bag. If desired, the neck stiffening member may be recessed to receive the resilient member therearound.

Figure 8:
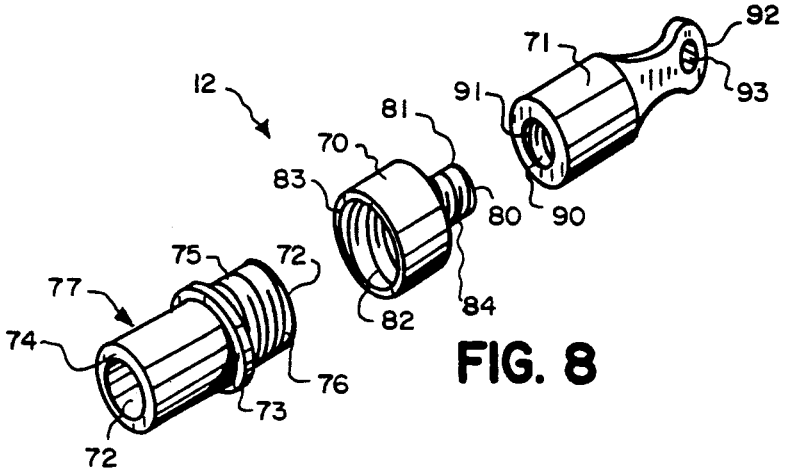

A removable cap assembly 12, as shown in FIG. 8, is comprised of throttle member 70 and closure member 71. Also shown is an alternate version of a neck stiffening member 77. In this embodiment, neck stiffening member 77 is a generally cylindrically shaped, molded plastic member with an axial opening 72 therethrough and having a flange 73 intermediate its length serving to separate the end 74, adapted to be inserted into the narrow neck of an inner vessel, from the protruding end 75, and external threads 76 on the protruding end 75. Throttle member 70 is a generally cylindrically shaped molded plastic member, having a variable axial opening therethrough, wherein the opening 80 at its forward end 81 has a smaller diameter than the opening 82 at its opposite end 83, being so sized as to be suitable for squirting. Forward end 81 also has external threads 84 thereon and the opposite end 83 has internal threads therein, adapted to engage threads 76 on the neck stiffening member. Closure member 71 is a generally cylindrically shaped molded plastic member having an axial opening 90 which extends only part way through the closure member. Internal threads 91 are adapted to engage threads 84 on throttle member 70. Forward end 92 of closure member 71 has a reduced diameter and also incorporates a transverse opening 93 therethrough, adapted for attachment of the end of a tethering cord or strap 94 (shown partially in FIGS. 1 and 2) which has its other end attached to the outer casing of the bota bag, thus serving to secure the removable cap assembly 12 to casing 11 to prevent it from becoming lost.

In operation, an inner vessel having a neck configuration such as shown in FIG. 7, or one having a neck stiffening member such as 77 inserted into the neck thereof, is placed in outer casing 11 and secured thereto by clamp 13. If the inner vessel is prefilled, the disposable cap is removed. If the inner vessel is not prefilled, it is now filled by the user. The removable cap assembly is then secured to the neck of the inner vessel by threading throttle member 70, with closure member 71 secured thereto, onto the threaded portion of the neck to close the vessel and hold the contents therein. A user desiring to pour liquid from the inner vessel can remove throttle member 70 and closure member 71, together as a unit, thus providing an opening 72 suitable for pouring. Alternatively, a user desiring to squirt liquid from the inner vessel would remove only closure member 71 from throttle member 70, thus providing a restricted opening 80 suitable for squirting. Squirting could be enhanced by squeezing the outer casing against the inner vessel.

Figure 9:
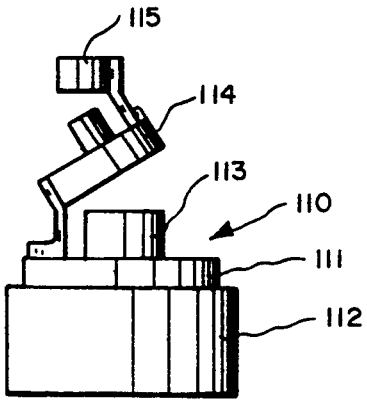

An alternative removable cap assembly 110 is shown in FIG. 9. This embodiment is adapted for use with an inner vessel having a threaded neck configuration such as shown in FIG. 7 or with another vessel employing a neck stiffening member such as shown in FIG. 6. This embodiment comprises a generally cylindrical molded plastic lid 111, having an internally threaded flange 112 adapted to engage the threads on the narrow neck of the inner vessel or on the neck stiffening member, and having a post extension 113, with an axial opening therethrough; a throttle member 114 similar to throttle member 70, see FIG. 8, except that it is adapted to be press-fit over post extension 113 rather than threadedly engaged, and is hingedly attached to lid 111; and a closure member 115, similar to closure member 71 except that it is adapted to be press-fit over the axial extension of the throttle member 114 rather than being threadedly engaged, and is hingedly attached to throttle member 114. In this embodiment, smooth, slightly tapered, cylindrical surfaces would be employed, rather than threads, on both the throttle member and the closure member. It is preferred that the entire cap assembly 110 be molded as a single piece. An advantage of such construction is that the lid, throttle member and closure member are all secured together so the various pieces do not become separated and lost.

Figure 11:
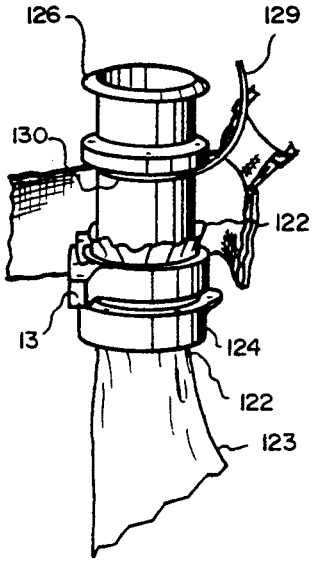
Figure 10:
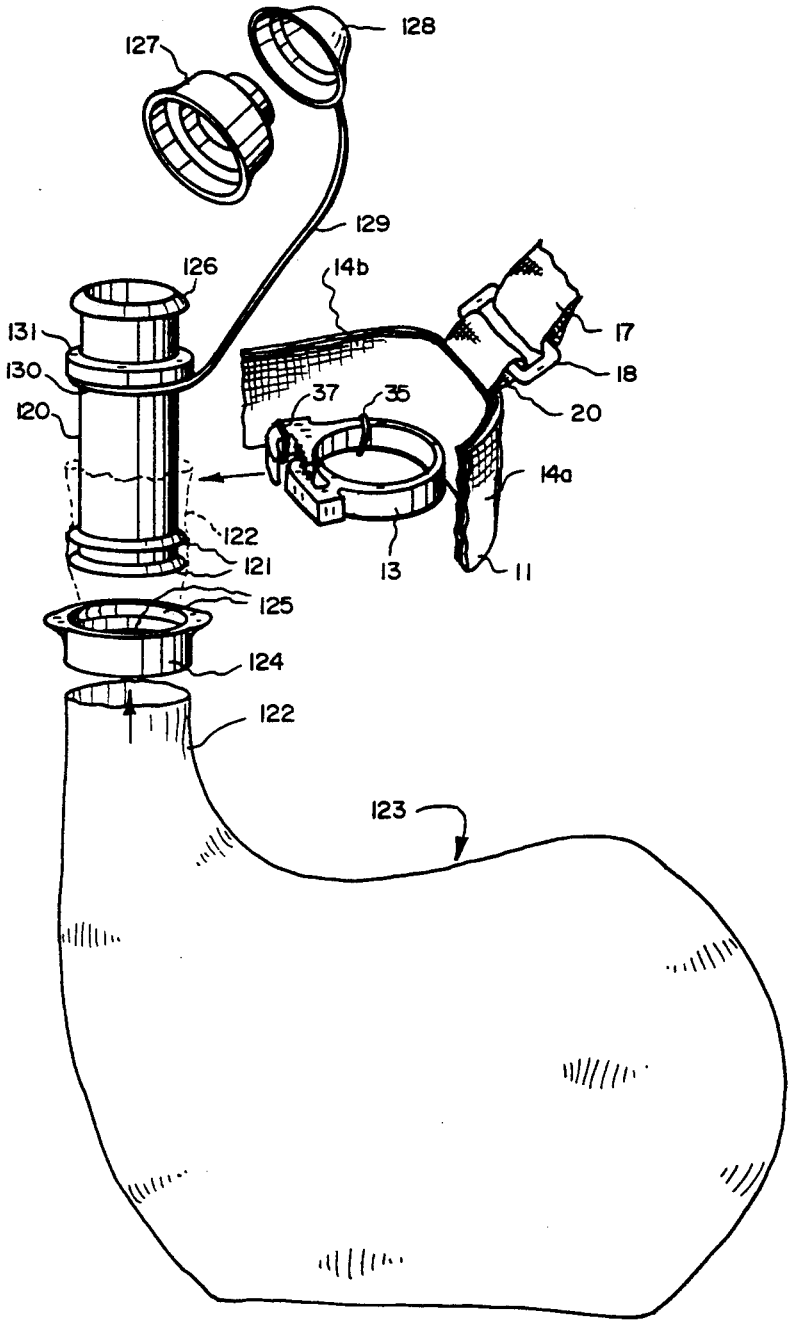

In order to ease manipulation of the inner vessel and neck attachment means as it is inserted and clamped into the outer casing, it may be desireable to removably and sealingly attach the separate neck attachment means as an inner vessel neck means in the neck portion of the inner vessel prior to insertion into the outer casing. For this purpose, a substantially rigid inner vessel neck piece 120, FIG. 10, is provided with ridges 121 molded about its end adapted to be inserted into the neck portion 122 of a flexible and collapsible inner vessel 123, such as a plastic bag vessel 50 as shown in FIG. 4. A compression nut 124 is placed around the outside of inner vessel neck portion 122 prior to insertion of neck piece 120, or the inner vessel 123 may be pulled through such compression nut 124, so that with the inner vessel neck portion 122 around the inner vessel neck piece 120, as shown in broken lines in FIG. 10, compression nut 124, which has grooves 125 therein to receive ridges 121, is snapped into place around the end of neck piece 120 to sealingly secure the neck piece 120 to inner vessel 123. The inner vessel 123 and neck piece 120, as a unit, can then be positioned in the outer casing and clamp 13 clamped about inner neck piece 120, FIG. 11, to secure the inner vessel in the outer casing so that it cannot slip down into the casing as the inner vessel collapses. Since inner vessel neck portion 122 is secured to neck piece 120 by compression nut 124, it does not have to be clamped between neck piece 120 and clamp 13, but such clamping provides a second seal and securement and is presently preferred, as shown in FIGS. 10 and 11. It should be noted that the inner vessel, when in the form of a collapsible flexible bag, is non-shape retaining so unless the neck is securely clamped in place, it would fall down into the outer casing and would not be available to a user.

The end of the inner vessel neck piece 120 that extends from the inner vessel may be configured with a ridge 126 to accept and hold in place a throttle member 127 snapped over the end ridge 126. A cap 128, attached to the neck with lesh 129, is configured to snap in place over throttle member 127 to close the vessel. Lesh 129 may be molded to cap 128 and may include a ring portion 130 which extends around neck piece 120 against shoulder 131 to hold it in place.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A container for liquids, comprising a flexible inner vessel having a relatively narrow neck portion opening into a larger and relatively deep storage portion to recieve and store liquid therein; a substantially rigid inner vessel neck means separate from and adapted to be removably and sealably received in said narrow neck portion of the inner vessel with an end thereof extending from the inner vessel; a cap assembly adapted to be removably secured to the end of the neck means extending from the inner vessel for closing the inner vessel; an outer casing having a relatively narrow neck portion opening into a larger and relatively deep portion, and sized and configured to enclose said inner vessel; and releasable clamping means secured to the neck portion of said outer casing to hold said substantially rigid neck means in releasable engagement with the clamping means when such neck means is received in said neck portion of the inner vessel to securely hold such neck means in a fixed position with respect to the outer casing.

2. A container according to claim 1, wherein the clamping means comprises a hose clamp adapted to be clamped or released by hand by a user.

3. A container according to claim 1, wherein the outer casing is substantially kidney shaped, has two substantially flat sides, has an elongate end extending from the narrow neck to the bottom of said container, and has an opposite bowed end.

4. A container according to claim 3, having a pair of loops attached intermediate the elongate end of the outer casing for securement of a carrying strap, a third loop attached to the narrow neck portion of the outer casing, and a fourth loop pivotally attached to, and near the top of, the bowed end of the outer casing.

5. A container according to claim 4, including a carrying strap adapted to carry the container over the shoulder of a user when attached between the third loop and the fourth loop, or around the waist of a user when attached between one of the pair of loops and the fourth loop.

6. A container according to claim 1, wherein the outer casing has access means for insertion of the inner vessel, and also has means for closing said access means after insertion of said inner vessel.

7. A container according to claim 6, wherein the access means comprises an elongate opening so sized and configured as to permit the insertion of the inner vessel, and also has a flap affixed near and along one edge of said opening which is so sized and configured as to cover said opening.

8. A container according to claim 1, wherein the outer casing has a relatively stiff and flat bottom portion adapted to support said container in an upright position, with the narrow neck portion at the top, when placed on a substantially flat surface.

9. A container according to claim 1, wherein the cap assembly comprises a generally cylindrical throttle member, with an axial opening therethrough, which engages the inner vessel neck means, and which has an axial extension at the other end thereof wherein the axial opening through said axial extension has a smaller diameter than the opening through the opposite end of said throttle member; and a closure member which engages said axial extension and closes the opening.

10. A container according to claim 1, wherein the removable cap assembly comprises a generally cylindrical cap attachment member with an axial opening therethrough and adapted to be secured to the neck attachment means of the inner vessel; a generally cylindrical throttle member, hingedly attached to said cap attachment member, with an axial opening therethrough, and having an axial extension wherein the axial opening through said axial extension has a smaller diameter than the opening through the opposite end of said throttle member, and wherein the end having the larger opening is adapted to engage said cap attachment member by means of a press fit; and a closure member hingedly attached to said throttle member and adapted to engage the axial extension of said throttle member by means of a press fit.

11. A container according to claim 1, wherein the substantially rigid inner vessel neck means is adapted to be secured to and in sealing relationship with the flexible inner vessel by the releasable clamping means which clamps the flexible inner vessel about the neck means while holding the neck means in fixed position with respect to the outer casing.

12. A container according to claim 1, wherein the substantially rigid inner vessel neck means is adapted to be secured to and in sealing relationship with the flexible inner vessel by securement means.

13. A container according to claim 12, wherein the securement means is a compression ring placed around the substantially rigid inner vessel neck means with the inner vessel neck portion sandwiched between the compression ring and the substantially rigid neck means.

14. A container according to claim 1, wherein the inner vessel is formed from relatively thin plastic sheet material.

15. A container for liquids, comprising a flexible inner vessel having a relatively narrow flexible neck portion opening into a larger and relatively deep storage portion to receive and store liquid therein; a substantially rigid inner vessel neck means separate from and adapted to be removably and sealably received in said narrow flexible neck portion of the inner vessel with an end thereof extending from the inner vessel; securement means for sealingly and removably securing the narrow flexible neck portion of the inner vessel around and against the substantially rigid inner vessel neck means; a cap assembly adapted to be removably secured to the end of the neck means extending from the inner vessel for closing the inner vessel; and outer casing having a relatively narrow neck portion opening into a larger and relatively deep portion, and sized and configured to enclose said inner vessel; and releasable clamping means secured to the neck portion of said outer casing and adapted to cooperate with said substantially rigid neck means when such neck means is received in said neck portion of the inner vessel to hold such neck means in a substantially fixed position with respect to the outer casing.

16. A container according to claim 15, wherein the securement means is a compression ring placed around the substantially rigid inner vessel neck means to sealably secure the inner vessel neck means in the inner vessel neck portion.

17. A container according to claim 16, wherein the flexible inner vessel neck portion is sandwiched between the compression ring and the substantially rigid neck means.

18. A container according to claim 17, wherein the compression ring has a groove therein, and wherein the substantially rigid neck means has a ridge therearound, whereby the compression ring may be positioned to surround and receive the ridge within the groove to thereby hold the ring in sealing position around the substantially rigid neck means.

19. An inner vessel according to claim 15, wherein said inner vessel is formed from relatively thin plastic sheet.

20. An inner vessel according to claim 15, wherein said inner vessel is lined with foil.

* * * * *